US007591549B2

(12) United States Patent
Komplin et al.

(10) Patent No.: US 7,591,549 B2
(45) Date of Patent: Sep. 22, 2009

(54) BUBBLE PURGING SYSTEM AND METHOD

(75) Inventors: Steven R. Komplin, Lexington, KY (US); Kent L. Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 250 days.

(21) Appl. No.: 11/153,179

(22) Filed: Jun. 15, 2005

(65) Prior Publication Data

US 2006/0284925 A1 Dec. 21, 2006

(51) Int. Cl.
*B41J 2/19* (2006.01)
*B41J 2/165* (2006.01)

(52) U.S. Cl. ..... 347/92; 347/22; 347/23

(58) Field of Classification Search ..... 347/92, 347/22, 23, 29, 30, 47, 61, 65
See application file for complete search history.

(56) References Cited

U.S. PATENT DOCUMENTS

| | | | |
|---|---|---|---|
| 4,646,105 | A | 2/1987 | Matsumoto et al. |
| 4,668,965 | A | 5/1987 | Tanaka et al. |
| 5,479,196 | A | 12/1995 | Inada |
| 5,483,265 | A | 1/1996 | Kneezel et al. |
| 5,495,271 | A | 2/1996 | Koitabashi et al. |
| 5,500,657 | A | 3/1996 | Yauchi et al. |
| 6,019,456 | A | 2/2000 | Onishi et al. |
| 6,132,023 | A | 10/2000 | Akiyama et al. |
| 6,145,956 | A | 11/2000 | Koitabashi et al. |
| 6,357,852 | B1 | 3/2002 | Premnath et al. |
| 6,659,600 | B2 | 12/2003 | Oda et al. |
| 6,695,428 | B2 | 2/2004 | Kao et al. |
| 6,715,855 | B2 | 4/2004 | Oda et al. |
| 6,843,281 | B1 | 1/2005 | Barth et al. |
| 2003/0090544 | A1 | 5/2003 | Sanada |

FOREIGN PATENT DOCUMENTS

| | | |
|---|---|---|
| EP | 0953447 | 11/1999 |
| JP | 2151447 | 6/1990 |
| JP | 2164545 | 6/1990 |
| JP | 6320760 | 11/1994 |
| JP | 9314860 | 12/1997 |

OTHER PUBLICATIONS

R.C ALT, "Air Bubble Expelling from an Ink Jet Printing Head," IBM TDB, p. 2511, (Jun. 11, 1978).

*Primary Examiner*—Shih-wen Hsieh
(74) *Attorney, Agent, or Firm*—Luedeka, Neely & Graham PC

(57) ABSTRACT

A method and system for purging bubbles from a fluid chamber of a micro-fluid ejection head containing a plurality of fluid chambers, an ejection actuator respectively associated with each of the fluid chambers, and a common fluid supply area for the fluid chambers. According to this exemplary method, one or more of the ejection actuators are pulsed with energy sufficient to expand a bubble present in one of the fluid chambers without substantially boiling the fluid in the common fluid supply area. A first temperature of the ejection head is maintained for a first period of time during bubble expansion so that the bubble in the fluid chamber is urged away from the fluid chamber. The ejection head temperature is decreased over a second period of time to lower the ejection head temperature to a second temperature lower then the first temperature.

20 Claims, 5 Drawing Sheets

FIG. 2
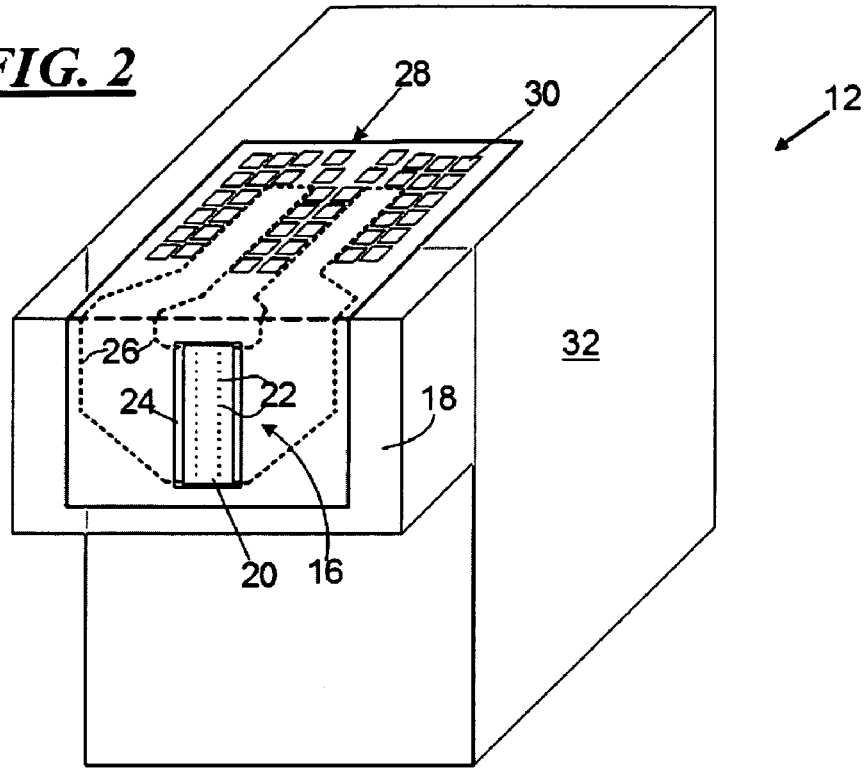
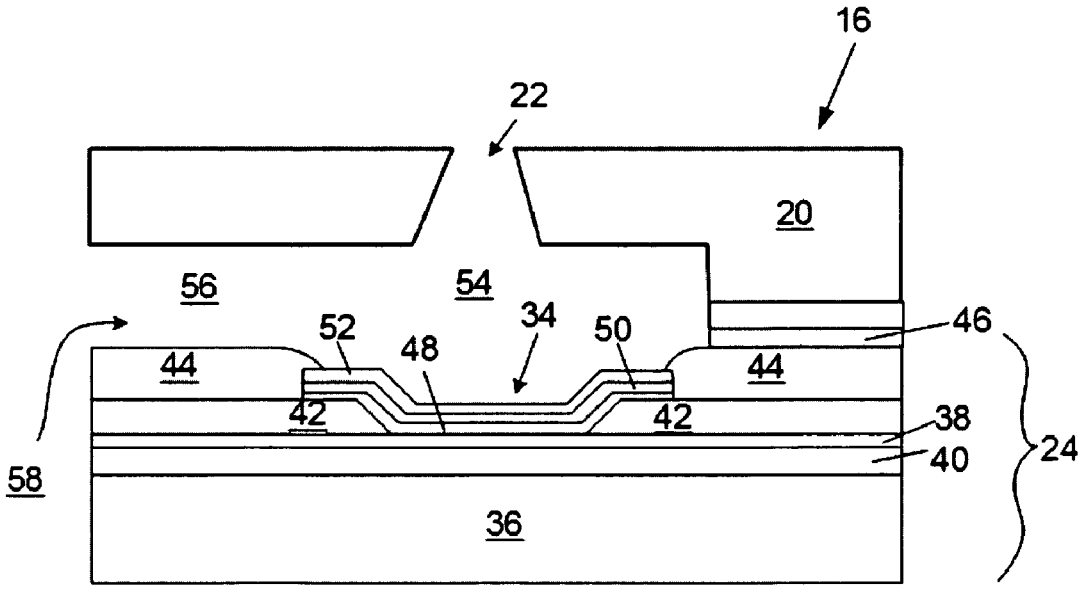
FIG. 3

FIG. 4
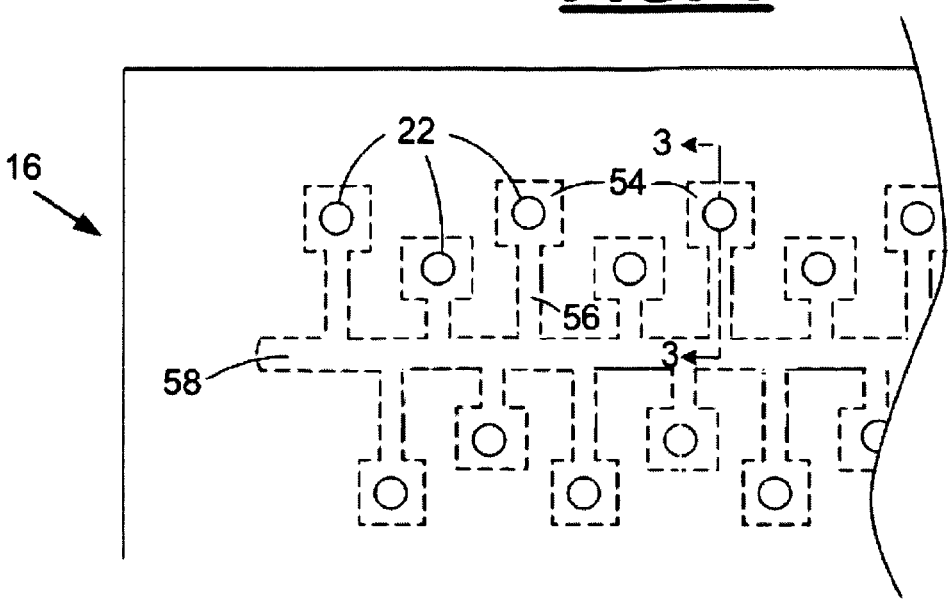
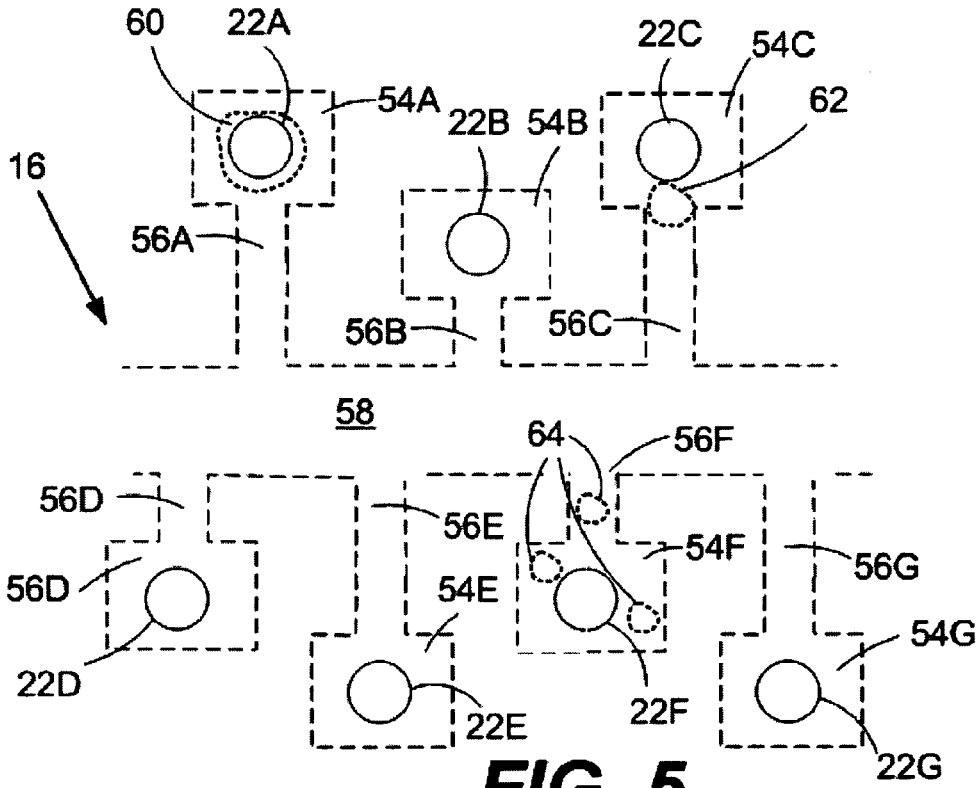
FIG. 5

BUBBLE PURGING SYSTEM AND METHOD

FIELD

The disclosure relates to a system and method for purging gas bubbles from a micro-fluid ejection head which, in some embodiments, may improve operating characteristics of a micro-fluid ejection device.

BACKGROUND AND SUMMARY

As micro-fluid ejection devices become smaller and the frequency of ejection of fluid from ejection heads for the devices becomes greater, the ejection heads have become more susceptible to a variety of occurrences which may lead to misfiring of certain ejection actuators on the ejection heads. One such occurrence is the presence of a gas bubble in a fluid chamber of the ejection head. Because of the small size of the fluid chambers and associated ejection orifices, even minute gas bubbles in the fluid chambers may be effective to block fluid flow from the ejection orifices. There are a number of sources that may lead to the formation of gas bubbles in the fluid chambers. For example, impact of the ejection head on a hard surface may form gas bubbles in the fluid chambers. Another source of gas bubbles may be dissolved air or oxygen in the fluid.

In order to reduce the occurrence of gas bubbles in the fluid chambers, impact of the ejection head may be minimized. Another method for reducing the occurrence of gas bubbles may be to provide an ejection head design which is less susceptible to retaining gas bubbles in the fluid chambers. However, neither of these solutions is completely satisfactory. Accordingly, there remains a need for an improved system and method for purging bubbles from a micro-fluid ejection head.

With regard to the foregoing, the disclosure provides in one exemplary embodiment a method for purging bubbles from a fluid chamber of a micro-fluid ejection head containing a plurality of fluid chambers, an ejection actuator respectively associated with each of the fluid chambers, and a common fluid supply area for the fluid chambers. According to this exemplary method, one or more of the ejection actuators are pulsed with energy sufficient to expand a bubble present in one of the fluid chambers without substantially boiling the fluid in the common fluid supply area. A first temperature of the ejection head is maintained for a first period of time during bubble expansion so that the bubble in the fluid chamber is urged away from the fluid chamber in the absence of applying a pressure to the fluid chamber. The ejection head temperature is decreased over a second period of time to lower the ejection head temperature to a second temperature lower then the first temperature.

In another exemplary embodiment, there is provided a micro-fluid ejection device including a micro-fluid ejection head containing a plurality of fluid chambers, fluid actuator devices associated with the fluid chambers, a fluid supply inlet, and fluid supply channels in fluid flow communication with the fluid supply inlet and each of the fluid chambers. A fluid supply reservoir is in fluid flow communication with the fluid supply inlet. The ejection actuators are capable of being pulsed with an energy sufficient to expand any bubbles present in the fluid chambers, without substantially boiling the fluid in the fluid supply inlet, and to force the bubbles present in the fluid chambers away from the fluid chambers.

An advantage of the exemplary embodiments can be that boiling the fluid in a common fluid supply area of the ejection head is substantially avoided. Furthermore, the system can use existing ejection actuators without the need for additional ejection head heaters to effect a temperature rise of the ejection head. Since individual ejection actuators can be used for the bubble purging procedure, heat may be directed specifically to chambers containing bubbles thereby enabling lower ejection head temperatures to be used to effectuate removal of the bubbles. Specific elements of the bubble purging procedure can enable bubbles to be purged and/or shrunk to the point where they disappear from the fluid chamber.

BRIEF DESCRIPTION OF THE DRAWINGS

Further features and advantages of exemplary embodiments disclosed herein may become apparent by reference to the detailed description when considered in conjunction with the figures, which are not to scale, wherein like reference numbers indicate like elements through the several views, and wherein:

FIG. 2 is a perspective view, not to scale, of a fluid cartridge and ejection head for a micro-fluid ejection device according to the disclosure;

FIG. 3 is a cross-sectional view, not to scale, of a portion of a micro-fluid ejection head taken through lines 3-3 of FIG. 4;

FIG. 4 is a plan view, not to scale, of a portion of a micro-fluid ejection head for a micro-fluid ejection device according to the disclosure;

FIG. 5 is a plan view, not to scale, of a portion of a micro-fluid ejection head having air bubbles trapped in fluid chambers and in a fluid supply channel;

DETAILED DESCRIPTION OF EXEMPLARY EMBODIMENTS

For the purposes of this disclosure, unless indicated otherwise, "temperature" means the temperature of an ejection head structure rather than of the fluid as it is difficult to measure and control fluid temperatures within ejection head structures as set forth herein.

Figure 1:
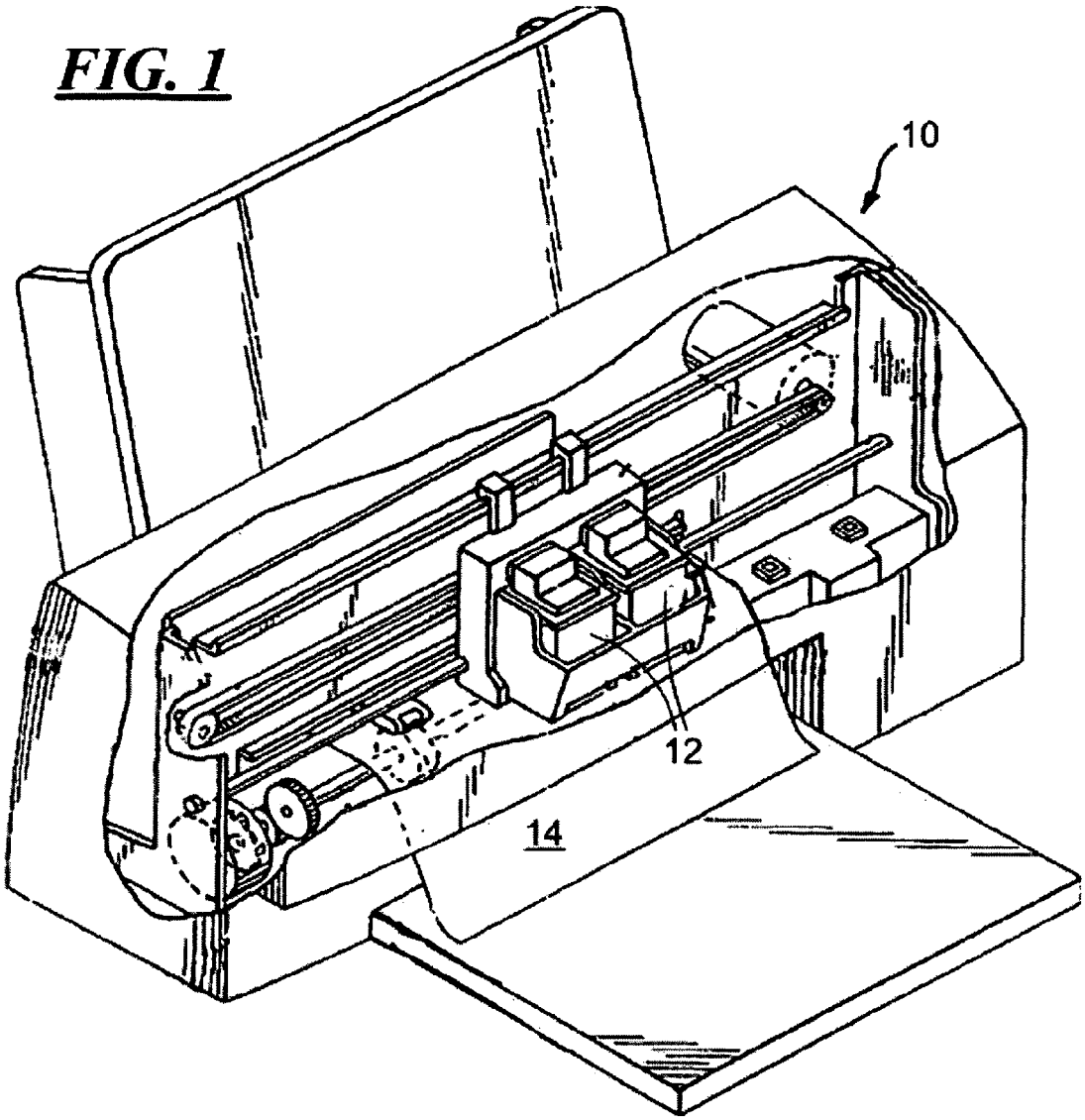
FIG. 1 is a perspective view, not to scale, of an exemplary micro-fluid ejection device according to the disclosure.

With reference to FIGS. 1 and 2 there are shown in perspective views, a fluid micro-fluid ejection device 10 including one or more fluid cartridges 12 for ejecting fluids, such as inks, therefrom onto a substrate or print media 14. The fluid cartridge 12 includes an ejection head 16 disposed on an ejection head area 18 of the fluid cartridge 12. As described in more detail below, the ejection head 16 is provided by a nozzle plate 20 containing ejection orifices 22 attached to a semiconductor substrate 24 containing fluid ejection actuators. Power may be provided to the ejection actuators on the substrate 24 as by electrical tracing 26 and a flexible circuit 28 containing electrical contact pads 30 which are in electrical communication with a controller in the micro-fluid ejection device 10. Fluid ejected by the ejection head 16 may be contained in the fluid cartridge 12 in a fluid reservoir 32 or in other ways, such as by a separate fluid supply reservoir remote from the ejection head 16.

FIG. 3 is a cross-sectional view and FIG. 4 is a partial plan view, not to scale, of a portion of an exemplary ejection head 16. The ejection head 16 is provided by the semiconductor substrate 24 containing a plurality of fluid ejection actuators such as heater resistor 34 and the nozzle plate 20. The heater resistor 34 is defined on a silicon substrate 36 by a resistive layer 38 deposited on a first insulating layer 40. A first metal layer 42 provides anode and cathode conductors for the heater resistor 34. A second insulating layer 44 insulates the first metal layer 42 from a second metal layer 46 providing power to the heater resistor 34. One or more passivation layers 48 and 50 and a cavitation layer 52 may be deposited over the heater resistor 34 to protect the heater resistor 34 from fluid corrosion and mechanical damage caused by collapsing of vapor bubbles during a fluid ejection sequence.

During a fluid ejection sequence, fluid, such as ink, is provided to a fluid chamber 54 through a fluid channel 56 that is in fluid flow communication with a common fluid supply area 58. When energy is provided to the heater resistor 34, fluid in the fluid chamber 54 adjacent the heater resistor 34 is superheated causing a vapor bubble to form which urges fluid in the chamber 54 through the ejection orifice 22. After ejection of fluid from the fluid chamber 54, the bubble collapses enabling fluid to refill the fluid chamber 54 by fluid flow through the fluid channel 56 from the common fluid supply area 58.

During manufacturing or handling of the fluid cartridges 12, air bubbles may form in the fluid channels 56 and fluid chambers 54 when the cartridge 12 is impacted on a hard surface, shaken, or otherwise moved in a manner sufficient to form air bubbles in the fluid channels 56 and fluid chambers 54. If the air bubbles are not eliminated, they may block or inhibit the flow of fluid to the chambers 54 from the common fluid supply area 58 or may block or inhibit ejection of fluid from the orifices 22. The elimination of air bubbles is expected to be even more critical as the size of the ejection heads 16 and resulting fluid passages continues to decrease.

Problematic air bubbles 60, 62, and 64 are illustrated in an enlarged portion of the ejection head illustrated in FIG. 5. Air bubble 60 is shown in a fluid chamber 54A blocking exit of fluid through an orifice 22A adjacent the chamber 54A. Air bubble 62 is shown blocking fluid flow through a fluid channel 56C to a fluid chamber 54C. Multiple small air bubbles 64 are shown in a fluid chamber 54F and fluid channel 56F while there are no air bubbles blocking fluid flow through orifices 22B, 22D, 22E, and 22G and fluid channels 56B, 56D, 56E, and 56G in this illustration. While the air bubbles 64 are not sufficiently large to block fluid flow in channel 56F and orifice 22F, the bubbles 64 may easily combine to form one or more bubbles large enough to block or otherwise inhibit fluid flow through the channel 56F or orifice 22F.

In order to substantially eliminate air bubbles from the ejection heads 16 that may cause fluid flow problems through the fluid channels 56 and ejection orifices 22, a bubble elimination scheme can be used. An aspect of such a scheme can include that boiling of fluid in the common fluid supply area 58 is not required, and, in fact, can be substantially avoided by a procedure described in more detail below.

Test data showed that non-nucleate heating (NNH) of a fluid, such as ink, for an appropriate period of time and at a predetermined temperature worked well at eliminating or at least substantially reducing the presence of air bubbles in the fluid chambers 54 and fluid channels 56. In order to create air bubbles in the ejection heads 16, the ejection heads 16 were impacted multiple times on a hard surface. A condition corresponding to the presence of air bubbles in the ejection heads 16 sufficient to block ink flow was confirmed by observation of print tests which demonstrated that a number of ejection orifices 22 were incapable of ejecting fluid, hereinafter referred to as "missing nozzles." For a first series of test, the average number of missing nozzles was about 100 per test, with a low of 36 and a high of 346 missing nozzles. For these tests, several different types of ink jet print heads containing different types of fluids were tested. The ejection heads 16 were not wiped and a controlled amount of fluid was not ejected after the heating and cooling sequence. The ejection heads 16 were heated at the indicated temperatures for the indicated period of time and the number of missing nozzle was determined for each temperature and period of time. Results of the bubble elimination tests are contained in the following Tables.

TABLE 1

Dye type ink jet print head

| | Temperature (° C.) | | | |
|---|---|---|---|---|
| Time (msec) | 90 | 95 | 100 | 105 |
| 1 | 2 | 0 | 4 | 1 |
| 100 | 5 | 0 | 1 | 2 |
| 2000 | 2 | 0 | 1 | — |
| 5000 | 0 | 3 | 1 | — |

TABLE 2

General purpose type ink jet print head

| | Temperature (° C.) | | | |
|---|---|---|---|---|
| Time (msec) | 90 | 95 | 100 | 105 |
| 1 | 45 | 0 | 4 | 3 |
| 100 | 46 | 6 | 3 | 3 |
| 2000 | 34 | 9 | 3 | — |
| 5000 | 40 | 21 | 3 | — |

TABLE 3

Photographic type ink jet print head

| | Temperature (° C.) | | | |
|---|---|---|---|---|
| Time (msec) | 90 | 95 | 100 | 105 |
| 1 | 19 | 4 | 2 | 0 |
| 100 | 29 | 4 | 3 | 0 |
| 2000 | 37 | 5 | 2 | — |
| 5000 | 15 | 7 | 2 | — |

The foregoing results indicate effective levels of bubble elimination from the print heads. It was observed, however, that the heating time at each of the indicated temperatures had more variability than desired. The test also indicated that the general purpose ink jet print head and the photographic ink jet print head may be more susceptible to bubble formation than an ink jet print head containing a dye type ink.

In another series of bubble elimination tests, nine dye type ink jet print heads and nine general purpose ink jet print heads were subjected to a standard installation maintenance algorithm for aligning and priming the print heads after creating air bubbles in the print heads by impacting the print heads on a hard surface. In this test, the average number of missing nozzles decreased to 44.8 from an initial average number of 205 missing nozzles. The standard installation maintenance algorithm includes activating an ejection head so that about 800 droplets of fluid are ejected from each nozzle at an ejection frequency ranging from about 9 to about 12 kHz, then the ejection head is wiped to remove any excess fluid from the ejection head.

In yet another series of bubble elimination tests, nine dye type ink jet print heads and nine general purpose ink jet print heads were subjected to a procedure in accordance with an embodiment of the disclosure. According to this procedure, the print heads were heated to 100° C. and held at this temperature for two seconds. The print heads were then cooled for 10 seconds, 800 drops of fluid were ejected from the print heads at a frequency of 24 kHz and the print heads were wiped to remove excess fluid from the print heads. Using this procedure, the average number of missing nozzles decreased from 176 to 1.7 missing nozzles.

Figure 6:
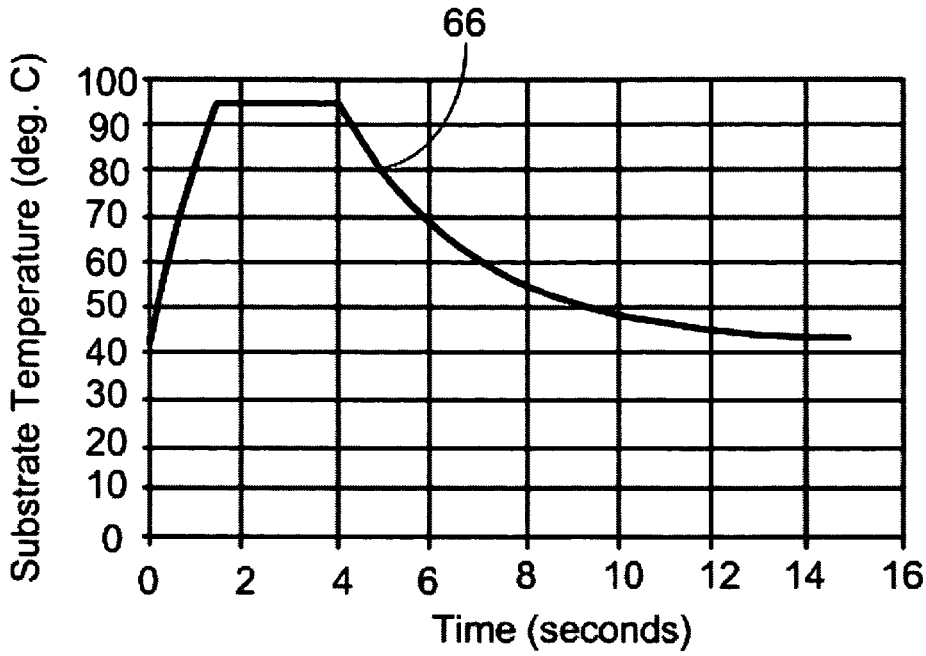
FIG. 6 is a graphical representation of a heating and cooling sequence for a purging sequence of an exemplary embodiment of the disclosure.

Based on the results of the foregoing bubble elimination test, a procedure was devised which was found to be suitable for eliminating air bubbles in most of the tested color ink jet print heads. According to the procedure, the print heads are heated to about 95° C. for about 2.5 seconds and are cooled for about ten seconds. The print heads are then wiped and a predetermined amount of fluid is ejected from the print heads at a frequency ranging from about 5 to about 30 kHz. A graphical representation of the heating and cooling cycle for the ejection head 16 is illustrated in FIG. 6 by curve 70.

Figure 7:
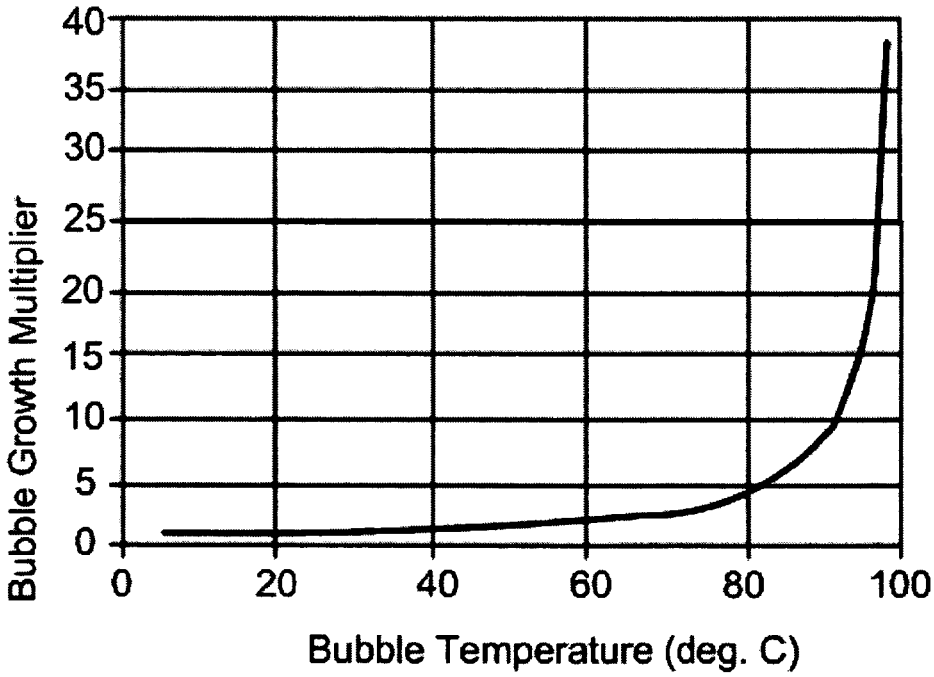
FIG. 7 is graphical representation of a bubble growth multiplier versus bubble temperature for a purging sequence as disclosed.

Without desiring to be bound by theoretical considerations, it is believed that the foregoing bubble elimination procedure is effective to expand air bubbles in the fluid chambers 54 until they are too large for the chambers 54 and are forced out of either the orifice 22 or through the channel 56 into the common fluid area 58. As illustrated by FIG. 7, an air bubble reaches its maximum growth rate at a temperature of from about 90 to about 100° C. Accordingly, maintaining a temperature below the normal fluid boiling point of 100° C. for a predetermine period of time is effective in expanding the air bubble so that the bubble will be forced from the chamber 54 or channel 56. The bubble expansion illustrated in FIG. 7 is primarily based on bubble growth due to water vapor. Dissolved air in the fluid may contribute to bubble expansion, but to much lower bubble growth levels.

Figure 8:
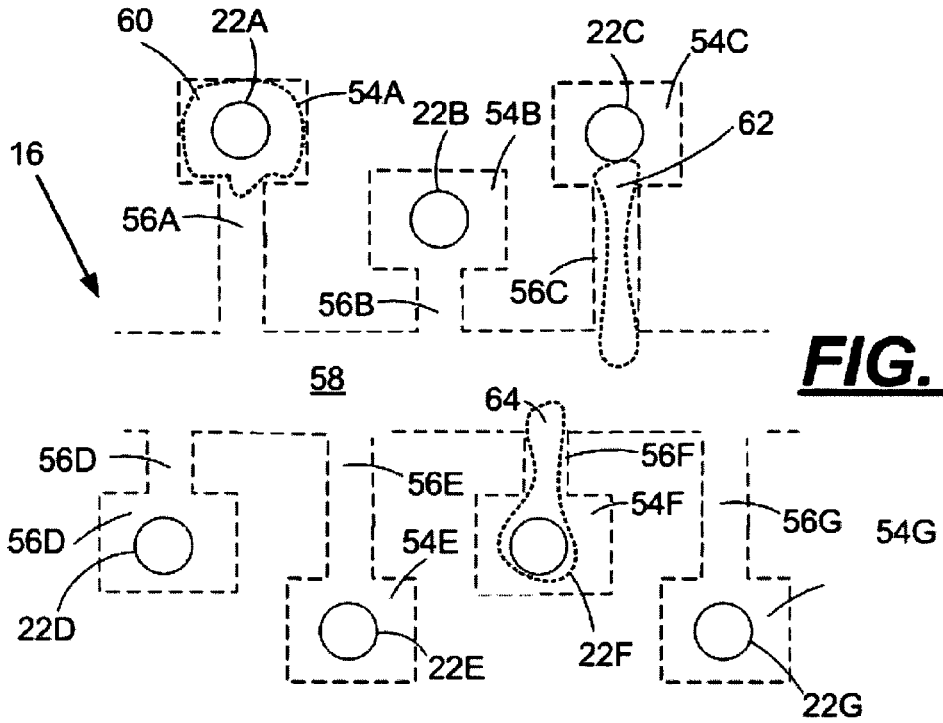
FIGS. 8-9 are plan views, not to scale of a portion of an ejection head during a bubble purging procedure.
Figure 9:
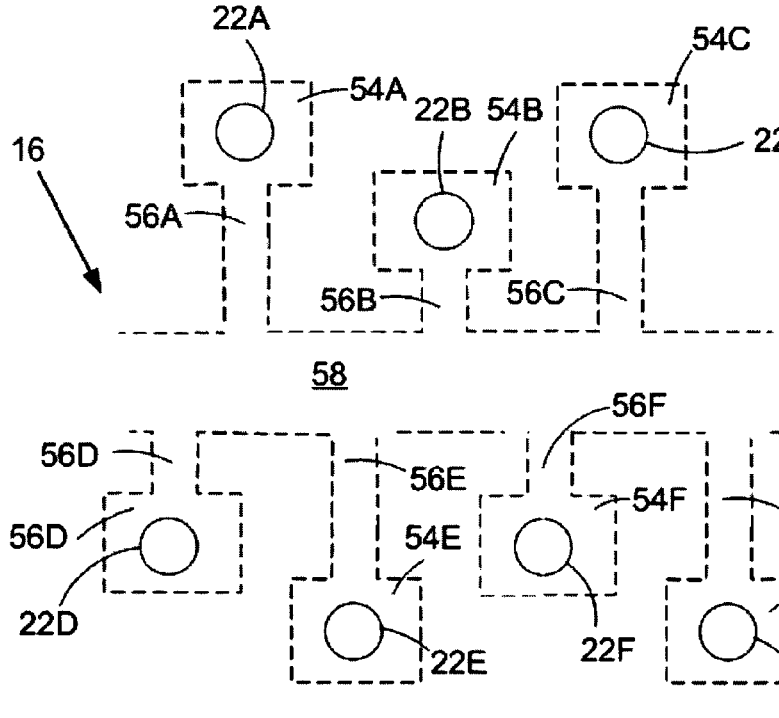

In FIG. 8, the bubbles 60, 62 and 64 have been expanded by the foregoing procedure. Expansion of bubble 62 has resulted in movement of the bubble 62 out of the fluid channel 56C into the common fluid supply area 58. Expansion of bubble 64 has caused bubble 64 to form a larger bubble 64, which will move out of the fluid channel 56F and fluid chamber 54F either through the orifice 22F or into the common fluid supply area 58. FIG. 9 is an illustration of a portion of the fluid ejection head 16 after conducting the procedure described above.

Occasionally a bubble may split in two or otherwise divided with part of the bubble remaining in the chamber 54, or a small bubble will grow and become large enough to block an orifice 22. Such bubbles tend to shrink and disappear when the fluid cools down during the cooling cycle.

While the foregoing procedure is typically conducted upon the installation of a fluid cartridge 12 in a fluid ejection device 10, the procedure may also be conducted to remove air bubbles or reduce the number of missing nozzles as part of a routine maintenance procedure for the ejection head 16. Bubble elimination routines may be activated during manufacture of the fluid cartridges or upon use of the fluid cartridge by a user.

Having described various aspects and exemplary embodiments of the disclosure and several advantages thereof, it will be recognized by those of ordinary skills that the exemplary embodiments are susceptible to various modifications, substitutions and revisions within the spirit and scope of the appended claims.

What is claimed is:

1. A method for purging bubbles from a fluid chamber of a micro-fluid ejection head containing a plurality of fluid chambers, an ejection actuator respectively associated with each of the fluid chambers, and a common fluid supply area for the fluid chambers, the method comprising:

pulsing one or more of the ejection actuators with energy sufficient to expand a bubble present in one of the fluid chambers without substantially boiling the fluid in the common fluid supply area;

maintaining a first temperature of the ejection head for a first period of time during bubble expansion so that the bubble in the fluid chamber is urged away from the fluid chamber in the absence of applying a pressure to the fluid chamber; and decreasing the ejection head temperature over a second period of time to lower the ejection head temperature to a second temperature lower then the first temperature.

2. The method of claim 1, wherein the first period of time ranges from about 0.1 to about 5 seconds.

3. The method of claim 2, wherein the second period of time ranges from about 5 to about 15 seconds.

4. The method of claim 1, further comprising wiping the ejection head after the second period of time.

5. The method of claim 4, further comprising ejecting a predetermined quantity of fluid from the ejection head after wiping the ejection head.

6. The method of claim 1, whereby any bubbles in the fluid chambers are expanded from an original volume to no more than about 25 times the original volume.

7. A micro-fluid ejection device comprising:

a micro-fluid ejection head containing a plurality of fluid chambers, fluid actuator devices associated with the fluid chambers, a fluid supply inlet, and fluid supply channels in fluid flow communication with the fluid supply inlet and each of the fluid chambers; a fluid supply reservoir in fluid flow communication with the fluid supply inlet; and a bubble elimination scheme associated with the micro-fluid ejection head for selectively heating any bubbles present in the fluid chambers with an energy sufficient to expand the bubbles, to force the bubbles present in the fluid chambers back in the fluid supply inlet without substantially boiling the fluid in the fluid chambers.

8. The micro-fluid ejection device of claim 7, wherein the bubble elimination scheme comprises a first period of time for heating the gas bubbles, and a second period of time for cooling the gas bubbles.

9. The micro-fluid ejection device of claim 8, wherein the first period of time ranges from about 0.1 to about 5 seconds.

10. The micro-fluid ejection device of claim 9, wherein the second period of time ranges from about 5 to about 15 seconds.

11. The micro-fluid ejection device of claim 7, wherein any bubbles present in the fluid chambers are expanded to no more than about 25 times an original volume of the bubbles.

12. The micro-fluid ejection device of claim 7, wherein the head is capable of being wiped.

13. The micro-fluid ejection device of claim 12, wherein the head is capable of having a predetermined amount of fluid ejected from the ejection head in association with forcing the bubbles away from the fluid chambers.

14. A method for purging bubbles from a fluid chamber of a micro-fluid ejection head containing a plurality of fluid chambers, an ejection actuator respectively associated with each of the fluid chambers, and a common fluid supply area for the fluid chambers, the method comprising:

pulsing one or more of the ejection actuators with energy sufficient to expand a bubble present in one of the fluid chambers without substantially boiling the fluid in the common fluid supply area;

maintaining a first temperature of the ejection head for a first period of time during bubble expansion so that the bubble in the fluid chamber is urged away from the fluid chamber in the absence of applying a pressure to the fluid chamber;

decreasing the ejection head temperature over a second period of time to lower the ejection head temperature to a second temperature lower then the first temperature;

wiping the ejection head; and ejecting a predetermined quantity of fluid from the ejection head.

15. The method of claim 14, wherein the first period of time ranges from about 0.1 to about 5 seconds, and the second period of time ranges from about 5 to about 15 seconds.

16. The method of claim 14, whereby any bubbles in the fluid chambers are expanded from an original volume to no more than about 25 times the original volume.

17. The method of claim 14, wherein the method is conducted upon the installation of the head in a fluid ejection device.

18. The method of claim 14, wherein the method is conducted as part of a maintenance procedure for the head.

19. The method of claim 18, wherein the maintenance procedure is activated during manufacture of the head.

20. The method of claim 18, wherein the maintenance procedure is activated upon use of the head by a user.

* * * * *

UNITED STATES PATENT AND TRADEMARK OFFICE

CERTIFICATE OF CORRECTION

PATENT NO. : 7,591,549 B2
APPLICATION NO. : 11/153179
DATED : September 22, 2009
INVENTOR(S) : Komplin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 656 days.

Signed and Sealed this

Twenty-first Day of September, 2010

David J. Kappos

David J. Kappos
*Director of the United States Patent and Trademark Office*